United States Patent [19]

Berger

[11] Patent Number: 4,869,274

[45] Date of Patent: Sep. 26, 1989

[54] COOLING APPARATUS FOR USE IN THE MANUFACTURE OF TOBACCO FILTERS

[76] Inventor: Richard M. Berger, 3612 Quail Meadow Pl., Midlothian, Va. 23113

[21] Appl. No.: 888,213

[22] Filed: Jul. 23, 1986

[51] Int. Cl.[4] ..... A24D 3/02; F16H 55/56

[52] U.S. Cl. ..... 131/92; 131/94; 493/43; 493/46; 493/48

[58] Field of Search ..... 131/280, 94, 88, 92; 493/42, 43, 44, 46, 48

[56] References Cited

U.S. PATENT DOCUMENTS

| | | |
|---|---|---|
| 3,095,343 | 6/1963 | Berger . |
| 3,313,306 | 4/1967 | Berger et al. . |
| 3,313,665 | 4/1967 | Berger . |
| 3,377,220 | 4/1968 | Berger et al. . |
| 3,455,766 | 7/1969 | Berger et al. . |
| 3,533,416 | 10/1970 | Berger et al. . |
| 3,658,626 | 4/1972 | Berger et al. . |
| 3,703,429 | 11/1972 | Berger et al. . |
| 3,811,451 | 5/1974 | Berger et al. . |
| 3,826,177 | 7/1974 | Berger et al. . |
| 4,390,031 | 6/1983 | Berger . |

*Primary Examiner*—V. Millin

[57] ABSTRACT

Apparatus for use in cooling heated filter rods particularly in the manufacture of cigarette filters is in the form a conduit through which the heated filter rod material is passed axially while being subjected to a flow of coolant gas. The conduit is provided with axially spaced rings of gas admission ports through which the coolant gas enters the conduit and adjacent rings of gas discharge ports through which the gas leaves the conduit. The ports in adjacent rings are slightly off-set circumferentially to provide uniform gas distribution through the filter rod material and the respective rings of admission ports are each provided with an admission ring manifold. The manifolds are connected in axial groups to respective headers so that independent sources of coolant gas can be provided to the respective groups whereby the cooling effect can be controlled lengthwise of the conduit. The gas ports may be angled vertically so as to provide flow of gas through the conduit in a counter current direction to the direction of passage of the filter rod material.

12 Claims, 1 Drawing Sheet

COOLING APPARATUS FOR USE IN THE MANUFACTURE OF TOBACCO FILTERS

BACKGROUND OF THE INVENTION

This invention relates to apparatus for use in the manufacture of filter means, more particularly tobacco smoke filter elements. More specifically, the instant inventive concepts are primarily concerned with the manufacture of filter means for cigarettes, although the apparatus of this invention is generally useful in the manufacture of other filter means, particularly for tobacco smoking means, whether they be cigarettes, cigars, pipes or the like. Since filters for cigarettes are particularly commercially important, the basic embodiments of the instant invention will be discussed as they relate to the production of filtered cigarettes.

In making tobacco smoke filters for use in connection with cigarettes and the like, bondable continuous filamentary tows of substantially continuous thermoplastic fibers, such as plasticized cellulose acetate fibers, polyethylene fibers, polypropylene fibers nylon fibers and the like, have conventionally been employed as the starting material. The term "continuous filamentary tow", as used in this specification and the appending claims, is intended to define a material such as that which results when filaments extruded from a plurality of spinnerets are brought together and combined to form a continuous body of fibers randomly oriented primarily in a longitudinal direction. In such a tow, the filaments are generally longitudinally aligned in substantially parallel orientation, but include crimped portions which may form short sections running more or less at random in non-parallel diverging and converging directions. Although the apparatus of this invention is applicable to the various filamentary materials of this type, since plasticized cellulose acetate is the most common thermoplastic fiber used in the manufacture of cigarette filters, the specification hereof will be generally set forth in terms of this material. However, it is to be understood that the instant inventive concepts are not to be limited to this preferred embodiment.

In the manufacture of filters for cigarettes and the like, a number of different factors must be considered. Filtration efficiency, which is the capacity to remove unwanted constituents from smoke, while highly desirable is only one factor important in producing a commercially acceptable filter. Other factors, such as pressure drop, taste, hardness and cost also determine commercial acceptance of these products. For example, cellulose acetate, one of the most commonly used substances in manufacturing cigarette filters has a relatively low filtration efficiency. Increased filtration efficiency obtained by increasing the density or length of a cellulose acetate fiber may cause a pressure drop across the filter which is excessive and commercially unacceptable. The use of activated carbon or other such materials having higher filtration efficiency may increase cost and deleteriously affect taste.

In recent years, air dilution has become a popular technique for compensation for the relatively low filtration efficiency of cigarette filters which have a pressure drop sufficiently low for commercial acceptance. In this technique, ventilating air is drawn into the filter peripherally and dilutes the smoke stream from the tobacco to thereby reduce the quantity of tar and other unwanted tobacco constituents drawn into the smoker's mouth with each puff.

The air dilution technique provides several obvious advantages:

It is an extremely economical method for reducing various solid phase constituents of tobacco smoke, generally referred to as "tar".

It also enables the removal or reduction of certain gas phase constituents of tobacco smoke such as carbon monoxide and nitrous oxide.

By varying the quantity of air introduced into the filter with each puff, it permits control, within reason, of the filtration process in order that efficiency and taste can be balanced.

One of the major challenges to the cigarette filter industry has been to design a filter and filter production techniques and apparatus for producing, at high speeds, large numbers of low cost filters capable of utilizing the air dilution technique. When the air dilution technique first became commercially important, most cigarette filters were produced with an over-wrap material applied to the outside of the filament bundle comprising the filter element in order to achieve a dimensionally stable product. The manufacturing process produced an axially elongated rod comprising a core of filaments contained by a surrounding over-wrap material called the "plug-wrap". After cutting the filter rods into small segments or plugs suitable for use as cigarette filters, a tipping over-wrap secured the segments to a tobacco column comprising a core of tobacco surrounded by a cigarette paper over-wrap. With the air dilution technique, cigarette filters produced in the foregoing mannner required a porous or permeable plug-wrap in order that the air introduced generally through selectively provided perforations in the tipping over-wrap merged with and diluted the smoke coming from the tobacco column.

Because the use of plug wrap has certain disadvantages in general discussed in some detail in U.S. Pat. Nos. 3,313,306 and 3,377,220 granted Apr. 11, 1967 and Apr. 9, 1968, respectively, the subject matter of which are incorporated herein in their entirety by reference, techniques for producing non-wrapped dimensionally stable filter elements were developed. The significance of producing a non-wrapped, dimensionally stable filter rod is even more pronounced for use in air diluted cigarettes in view of the high cost of porous plug-wrap materials.

Numerous techniques are available for producing both plug-wrapped and non-wrapped filter elements from the continuous filamentray tow. In the case of non-wrapped filter elements, for example, such techniques may involve either a mechanical or pneumatic conveyance of the tow through various processing stations, and generally all of the known techniques involve heat bonding of the filamentary tow materials to form a dimensionally stable filter rod. This may, for example, be effected by the peripheral injection of steam into the filamentary tow as the tow is conveyed axially through a tubular heating station. In all cases, it is then necessary to stabilize and harden the rod for further processing by cooling the heated tow. When steam is used for heat bonding, it may also be preferable, in addition to cooling the rod, also to remove excess moisture. In low-speed processes or in processes where adequate space is available, the design of apparatus used for cooling the rod, for example by the injection of coolant gas, may not be particularly critical. In high speed production, however, where the rod is travelling at speeds in excess of 400 meters per minute, or in processes where space is a factor, it is desirable to have an extremely effective rod cooling apparatus capable of providing rapid cooling of the rod in a minimum length of travel. Moreover, prior to cooling, the filter rod is somewhat fragile, and accordingly the cooling apparatus should, desirably, be capable of maintaining the rod shape without damage to the rod surface. It is an object of the present invention to provide a cooling apparatus suitable for this purpose.

SUMMARY OF THE INVENTION

The invention provides a cooling apparatus for use in cooling a heated filter rod, as described, by injection of air or other coolant gas as the rod is conveyed axially through the apparatus. Preferably, the apparatus may include means for controlling the cooling effect lengthwise thereof to provide progressively increased cooling as the rod proceeds through the apparatus so that relatively gentle cooling can be applied to the somewhat fragile heated rod as it enters the apparatus, and the cooling effect can then be increased in stages as the rod hardens.

In accordance with one aspect of the invention there is provided an apparatus for use in cooling heated filter rod material comprising a conduit for axial passage therethrough of the rod material received from a heating station, the conduit having an inlet end and an outlet end, a plurality of axially spaced rings of circumferentially spaced gas admission ports in the conduit, the ports in adjacent rings being relatively off-set circumferentially at an angle of off-set which is smaller than the angle between adjacent ports in a ring, a plurality of axially spaced rings of circumferentially spaced gas discharge ports in the conduit adjacent the respective rings of gas admission ports, and gas supply means for delivering coolant gas to the gas admission ports.

The ports in at least some of the rings may be angled lengthwise of the conduit so as to cause the coolant gas in flowing through and across the conduit as between the respective rings of admission and discharge ports, to flow in a countercurrent direction to the direction of travel of the rod material, the gas discharge ports preferably being disposed in diametrically opposed locations to the adjacent rings of admission ports and correspondingly angled for this purpose.

The rings of gas admission ports may be divided into respective groups lengthwise of the apparatus for receipt through respective inlet manifold rings or the like of coolant gas of different characteristics, e.g. different temperatures and/or pressures, whereby the cooling effect may be controlled lengthwise of the apparatus, with gentler cooling being effected at the rod admission end of the apparatus and progressively increased cooling being effected toward the rod exit end as the rod material becomes more stable. For optimum cooling, refrigerated air may be used as the coolant gas.

The provision of multiple rings of coolant admission ports which are circumferentially off-set ring to ring (i.e. at an angle of off-set which is smaller than the angle between adjacent ports in a ring) provides the apparatus with lines of coolant ports which are somewhat helically oriented around the conduit so as to provide substantially uniform distribution of the cooling gas around the volume of the conduit. Thus, the apparatus allows for optimum coolant gas coverage within a small length of rod travel and provides progressive cooling control lengthwise of the apparatus.

Cooling apparatus in accordance with the invention may be used effectively in an wide variety of filter manufacturing processes and techniques. Some of the processes to which the cooling apparatus is applicable are disclosed, for example, in the following patents, the contents of each of which are expressly incorporated herein by reference: U.S. Pat. Nos. 3,095,343; 3,313,665; 3,377,220; 3,455,766; 3,533,416; 3,658,626; 3,703,429; 3,811,451; 3,826,177; and 4,390,031.

Additional features and advantages of the invention will be aparent from the following description and claims read in conjunction with the attached drawings.

DESCRIPTION OF PREFERRED EMBODIMENTS

The illustrated cooling apparatus 10 is particularly suitable for use in cooling a cigarette filter rod after it has been heated, for example by steam injection. The apparatus may, for example, be used in a process as disclosed in the above-noted U.S. Pat. No. 4,390,031, wherein the filter material is conveyed pneumatically in a processing conduit 60 through various processing stations, apparatus 10 being used in place of the apparatus forming cooling station 84 disclosed in the patent.

Figure 1:
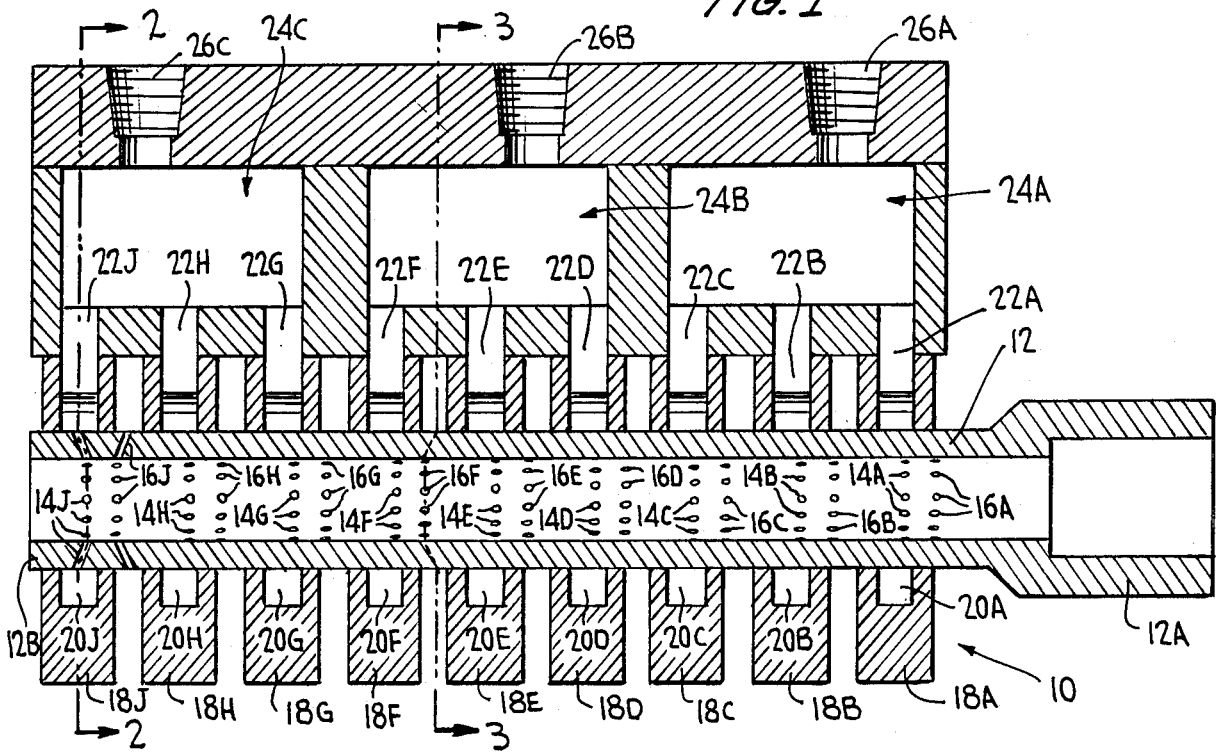
FIG. 1 is a sectional elevational view of a cooling apparatus in accordance with the invention for use, for example, in cooling cigarette filter rods during their manufacture.
Figure 4:
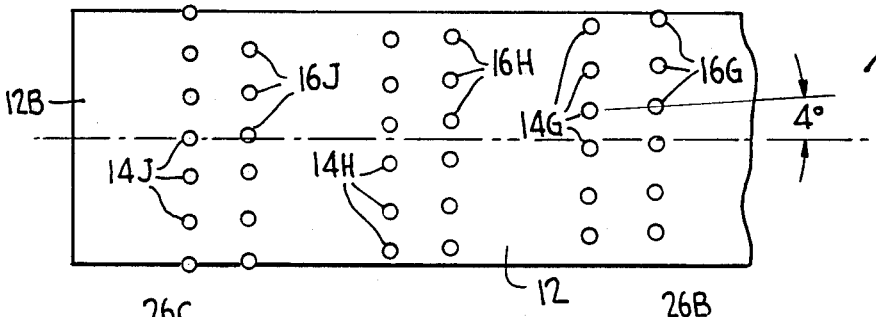
FIG. 4 is an enlarged elevational view of portion of a conduit forming a part of the apparatus.
Figure 2:
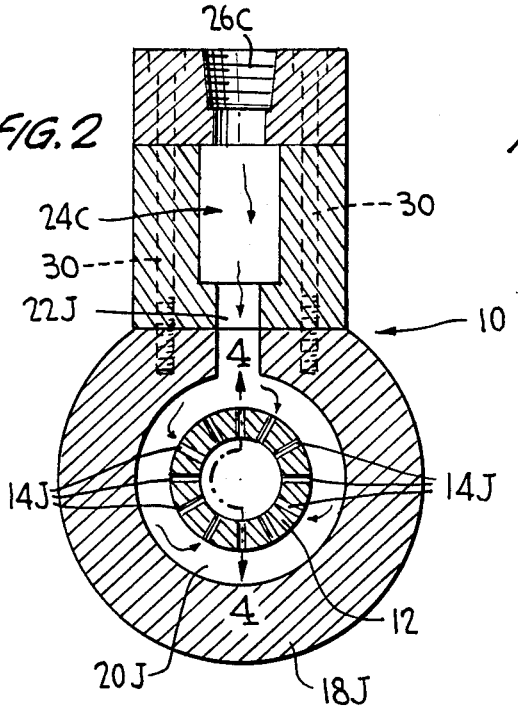
FIG. 2 is a sectional view on line 2—2 of FIG. 1.
Figure 3:
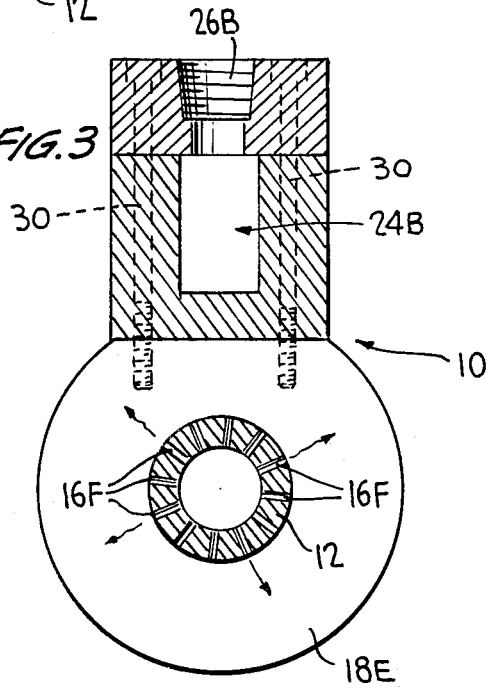
FIG. 3 is a sectional view on line 3—3 of FIG. 1.

Apparatus 10 includes a central filter rod flow-through conduit 12 having an inlet end 12A and an outlet end 12B for connection, for example, into a processing conduit 60 as in the above noted patent. Inlet end 12A is shown as an enlarged socket, but any suitable end connections may be employed. Along the length of conduit 12 there are provided alternate rings of coolant gas admission ports 14A–14J and coolant gas discharge ports 16A–16J. The ports in each ring are equally spaced circumferentially around the conduit and in the illustrated example there are 12 ports in each ring, conveniently of about one sixteenth inch diameter. The respective admission and discharge ports are disposed so that in each adjacent set of rings there is a discharge port diametrically opposite an admission port. The ports are angled, for example, at about 25 degrees to the vertical (see ports 14J and 16J in FIG. 1), so that gas flow from the respective admission ports, across the conduit to and through the respective discharge ports is in a countercurrent direction to the direction of travel of the heated filter rod through the conduit from the inlet end to the outlet end. Further, as shown most clearly in FIG. 4, the ports in adjacent rings are circumferentially off-set at an angle, conveniently four degrees, which is considerably less than the circumferential angle (30 degrees in the described embodiment) between the individual ports in each ring. Thus, the ports are disposed in somewhat helically extending lines lengthwise of the conduit so as to distribute the coolant gas substantially uniformly around the circumference of the filter rod as it proceeds through the cooling area of the conduit.

The rings of coolant admission ports 14A–14J are surrounded by respective coolant admission ring assemblies 18A–18J which provide respective annular gas manifolds 2OA–2OJ around the respective rings or ports, and radial ducts 22A–22J connecting the respective manifolds to coolant gas admission headers 24A, 24B, 24C. It will be seen that the respective manifolds 2OA–2OJ are connected in groups of 3 to the respective headers, and the headers have respective gas inlet ports 26A, 26B, 26C whereby they may be connected respectively to coolant gas supplies having different cooling characteristics, e.g. refrigerated air of different temperatures and/or pressures, so that the cooling effect can be controlled along the length of conduit 12. It is also evident that the respective rings of gas discharge ports 16A–16J are open to atmosphere between the manifold ring assemblies so that the coolant gas, after passing through the heated filter rod, may be discharged from the apparatus. In practice, the rings of discharge ports could be surrounded by discharge manifolds for collection of the exhaust gas.

In the drawings, the admission ring assemblies 18A–18J for simplification, are shown as solid one-piece items. In practice, however, they may be formed from interconnected sandwiched annular plate members. The headers 24A–24C may be box-like assemblies connected to the ring assemblies 18A–18J by suitable screws 30 or the like. It will be understood that the respective headers and admission ring assemblies effectively distribute coolant gas circumferentially to the respective ports in each ring, and the division of the rings into groups lengthwise of the apparatus allows control of the cooling effect as between gentler cooling at the inlet end of the device with progressively increased cooling along its length.

While only a preferred embodiment of the invention has been described herein in detail, the invention is not limited thereby and modifications can be made within the scope of the attached claims.

What is claimed is:

1. Apparatus for use in cooling heated filter rod material comprising a conduit for axial passage therethrough of the material received from a heating station, the conduit having an inlet end and an outlet end, a plurality of axially spaced rings of circumferentially spaced gas admission ports in the conduit, the ports in adjacent rings being offset to each other circumferentially of the conduit, a plurality of axially spaced rings of circumferentially spaced gas discharge ports in the conduit adjacent the respective rings of gas admission ports, and gas supply means for delivering coolant gas to the gas admission ports.

2. The invention as defined in claim 1 wherein respective gas discharge ports are located diametrically opposite respective gas admission ports.

3. The invention as defined in claim 1 wherein the ports in at least some of the rings are angled lengthwise of the conduit for causing coolant gas to flow through and across the conduit in a countercurrent direction to the direction of travel of the rod material through the conduit from the inlet end to the outlet end.

4. The invention as defined in claim 3 wherein the gas discharge ports are located diametrically opposite respective admission ports.

5. The invention as defined in claim 1 wherein the gas supply means includes means for delivering separate supplies of coolant gas to separate axial groups of the rings of gas admission ports so as to provide a means for controlling cooling of the filter rod material lengthwise of the apparatus.

6. The invention as defined in claim 1 wherein the gas supply means includes an admission ring for each ring of admission ports, the admission ring defining an annular manifold around the ring of ports and a supply duct leading into the manifold from the exterior of the assembly.

7. The invention as defined in claim 6 including separate headers connected to respective axially adjacent groups of the supply ducts, and means for supplying each header with coolant gas from a separate source for controlling cooling of the filter rod material lengthwise of the apparatus.

8. Apparatus for use in cooling heated filter rod material comprising a conduit for axial passage therethrough of the material received from a heating station, the conduit having an inlet end and an outlet end, a plurality of axially spaced rings of circumferentially spaced gas admission ports in the circumferentially spaced gas discharge ports in the conduit adjacent the respective rings of the gas admission ports, a gas admission ring for each ring of admission ports defining an annular manifold around the ring of admission ports and a supply duct for coolant gas leading into the manifold from the exterior of the admission ring, the respective admission rings being spaced apart so as to permit discharge of coolant gas from the conduit through the respective rings of discharge ports

9. The invention as defined in claim 8 including separate headers for supplying axially adjacent groups of the admission rings with coolant gas from separate sources whereby cooling of the filter rod material may be controlled lengthwise of the conduit.

10. The invention as defined in claim 8 wherein the ports in adjacent rings of ports are relatively off-set circumferentially at an angle which is smaller than the angle between adjacent ports in a ring.

11. The invention as defined in claim 10 wherein there are twelve ports in a ring and the angle of off-set between the ports in adjacent rings is about four degrees.

12. The invention as defined in claim 8 wherein the ports in at least some of the rings are angled lengthwise of the conduit for providing coolant gas flow therethrough in a direction countercurrent to the direction of movement of the rod material through the conduit from the inlet end to the outlet end.

* * * * *